US009174451B2

(12) United States Patent
Hara et al.

(10) Patent No.: US 9,174,451 B2
(45) Date of Patent: Nov. 3, 2015

(54) CLEANING DEVICE FOR LIQUID EJECTING HEAD, AND LIQUID EJECTING APPARATUS WITH THE SAME

(71) Applicant: SEIKO EPSON CORPORATION, Tokyo (JP)

(72) Inventors: Kazuhiko Hara, Shiojiri (JP); Toshihiro Shinbara, Matsumoto (JP); Takayuki Kawakami, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/532,566

(22) Filed: Nov. 4, 2014

(65) Prior Publication Data

US 2015/0124023 A1 May 7, 2015

(30) Foreign Application Priority Data

Nov. 7, 2013 (JP) ..... 2013-230941

(51) Int. Cl.
*B41J 2/165* (2006.01)

(52) U.S. Cl.
CPC ..... *B41J 2/16544* (2013.01); *B41J 2/16535* (2013.01); *B41J 2002/1655* (2013.01)

(58) Field of Classification Search
CPC ..... B41J 2/16517
See application file for complete search history.

(56) References Cited

U.S. PATENT DOCUMENTS

| | | | | |
|---|---|---|---|---|
| 4,823,153 | A * | 4/1989 | Coburn | 347/154 |
| 5,864,348 | A * | 1/1999 | Fritsch et al. | 347/22 |
| 2008/0158291 | A1 * | 7/2008 | Satake | 347/33 |
| 2009/0289993 | A1 * | 11/2009 | Yamaguchi | 347/33 |
| 2010/0245466 | A1 * | 9/2010 | Inoue | 347/30 |
| 2012/0069088 | A1 * | 3/2012 | Morimoto et al. | 347/32 |
| 2013/0250000 | A1 | 9/2013 | Yamamoto | |

FOREIGN PATENT DOCUMENTS

| | | |
|---|---|---|
| JP | 2001-260368 | 9/2001 |
| JP | 2013-199081 | 10/2003 |
| JP | 2004-338223 | 12/2004 |
| JP | 2005-066964 | 3/2005 |
| JP | 2010-029579 | 2/2010 |

* cited by examiner

*Primary Examiner* — Stephen Meier
*Assistant Examiner* — John P Zimmermann
(74) *Attorney, Agent, or Firm* — Workman Nydegger

(57) ABSTRACT

The liquid ejecting apparatus includes a cleaning member that is brought into contact with a region including a nozzle face of the liquid ejecting head that ejects a liquid from nozzles formed in the nozzle face such that the cleaning member is capable of cleaning the liquid ejecting head, the cleaning member having a pile section in which a plurality of pile elements are raised in a portion of the cleaning member in contact with the region of the liquid ejecting head.

18 Claims, 5 Drawing Sheets

CLEANING DEVICE FOR LIQUID EJECTING HEAD, AND LIQUID EJECTING APPARATUS WITH THE SAME

BACKGROUND

1. Technical Field

The present invention relates to a cleaning device for a liquid ejecting head, and to a liquid ejecting apparatus equipped with the cleaning device.

2. Related Art

An example of a known liquid ejecting apparatus is an ink jet printer. Such a printer has a liquid ejecting head that is capable of ejecting liquid ink and a cleaning device that cleans the liquid ejecting head. The liquid ejecting head ejects an ink from a plurality of nozzles formed in the nozzle face onto printing media such as paper sheets to form images on the printing media. The cleaning device wipes off the ink adhering to the nozzle face to clean the liquid ejecting head.

JP-A-2001-260368 discloses an example of a cleaning device for a liquid ejecting head. The cleaning device may cause a portion of fabric tape to contact a nozzle face to which ink is adhering in order to wipe the ink off the nozzle face.

The printer can cause, for example, paper dust of paper sheets to be attached to the nozzles and then clog the nozzles. Then, if the printer is continuously used with the nozzles being clogged, the ink remaining on the nozzles can become solidified due to thermal history.

In this case, there is concern that the cleaning device according to JP-A-2001-260368 does not remove the ink that has remained and solidified on the nozzles (hereinafter referred to as solid materials) or resolve the clogging because the fabric tape is only brought into contact with the nozzle face of the liquid ejecting head to wipe the ink off, that is, because the fabric tape does not enter the nozzles.

SUMMARY

An advantage of some aspects of the invention is to provide a cleaning device for a liquid ejecting head that effectively removes solid materials remaining on nozzles of the liquid ejecting head, and a liquid ejecting apparatus equipped with the cleaning device.

Means and its effect for solving the above problems will be described below.

To solve this problem, the cleaning device for the liquid ejecting head includes a cleaning member that is brought into contact with a region including a nozzle face of the liquid ejecting head that ejects a liquid from nozzles formed in the nozzle face such that the cleaning member is capable of cleaning the liquid ejecting head, wherein a pile section in which a plurality of pile elements are raised is formed in a portion of the cleaning member that is brought into contact with the nozzle face when the cleaning member cleans the liquid ejecting head.

The raised pile elements easily enter fine spaces. Therefore, according to the cleaning device, when the cleaning member is brought into contact with the region including the nozzle face of the liquid ejecting head, the tips of the raised pile elements on the pile section enter the nozzles to impinge against the ink or the like remaining and solidified on the nozzles. Therefore, the solidified ink or the like remaining on the nozzles is physically broken due to impingement by the pile section. After that, for example, if negative pressure acts on the nozzles, the ink or the like is easily discharged out from the nozzles. Consequently, an effect of removing the ink or the like remaining and solidified on the nozzles of the liquid ejecting head may be enhanced.

Preferably, in the cleaning device for the liquid ejecting head, the raised pile elements have a thickness smaller than the orifice size of the nozzles and a length such that the raised pile elements are capable of entering the nozzles.

According to this configuration, the raised pile elements on the pile section formed on the cleaning member easily enter the nozzles when the cleaning member is brought into contact with the region including the nozzle face during cleaning of the liquid ejecting head. Therefore, during cleaning of the liquid ejecting head, the cleaning device causes the raised pile elements to easily impinge against the ink or the like remaining and solidified on the nozzles.

Preferably, in the cleaning device for the liquid ejecting head, the cleaning member is a cloth, and the raised pile elements are formed of fibers each having a diameter smaller than 20 μm.

According to this configuration, the raised pile elements on the pile section easily enter the nozzles during cleaning of the liquid ejecting head. In addition, the cleaning member is brought into contact with the region including the nozzle face of the liquid ejecting head so as to absorb the liquid remaining on the nozzles and the nozzle face of the liquid ejecting head. Therefore, an effect of cleaning the liquid ejecting head may be enhanced.

In addition, to resolve this problem, a liquid ejecting apparatus includes a liquid ejecting head that ejects a liquid from nozzles, and a cleaning device for a liquid ejecting head having the above-described configuration.

According to this configuration, the liquid ejecting apparatus is obtained in which an effect of removing the ink or the like remaining and solidified on the nozzles of the liquid ejecting head may be enhanced.

Preferably, the liquid ejecting apparatus includes a cleaning liquid supplying mechanism that supplies a cleaning liquid to at least one of the nozzle face of the liquid ejecting head and the cleaning member.

According to this configuration, the cleaning liquid supplying mechanism may moisten the ink or the like remaining and solidified on the nozzles of the liquid ejecting head with the cleaning liquid to soften the solidified ink or the like. Therefore, according to the liquid ejecting apparatus, the raised pile elements on the pile section may impinge against the solidified ink or the like to easily break the solid ink or the like during cleaning of the liquid ejecting head, whereby an effect of removing the ink or the like remaining and solidified on the nozzles of the liquid ejecting head may be enhanced.

BRIEF DESCRIPTION OF THE DRAWINGS

The invention will be described with reference to the accompanying drawings, wherein like numbers reference like elements.

DESCRIPTION OF EXEMPLARY EMBODIMENTS

An embodiment that embodies the liquid ejecting apparatus in an ink jet printer (hereinafter may be abbreviated as "printer") will now be described with reference to the drawings.

Figure 1:
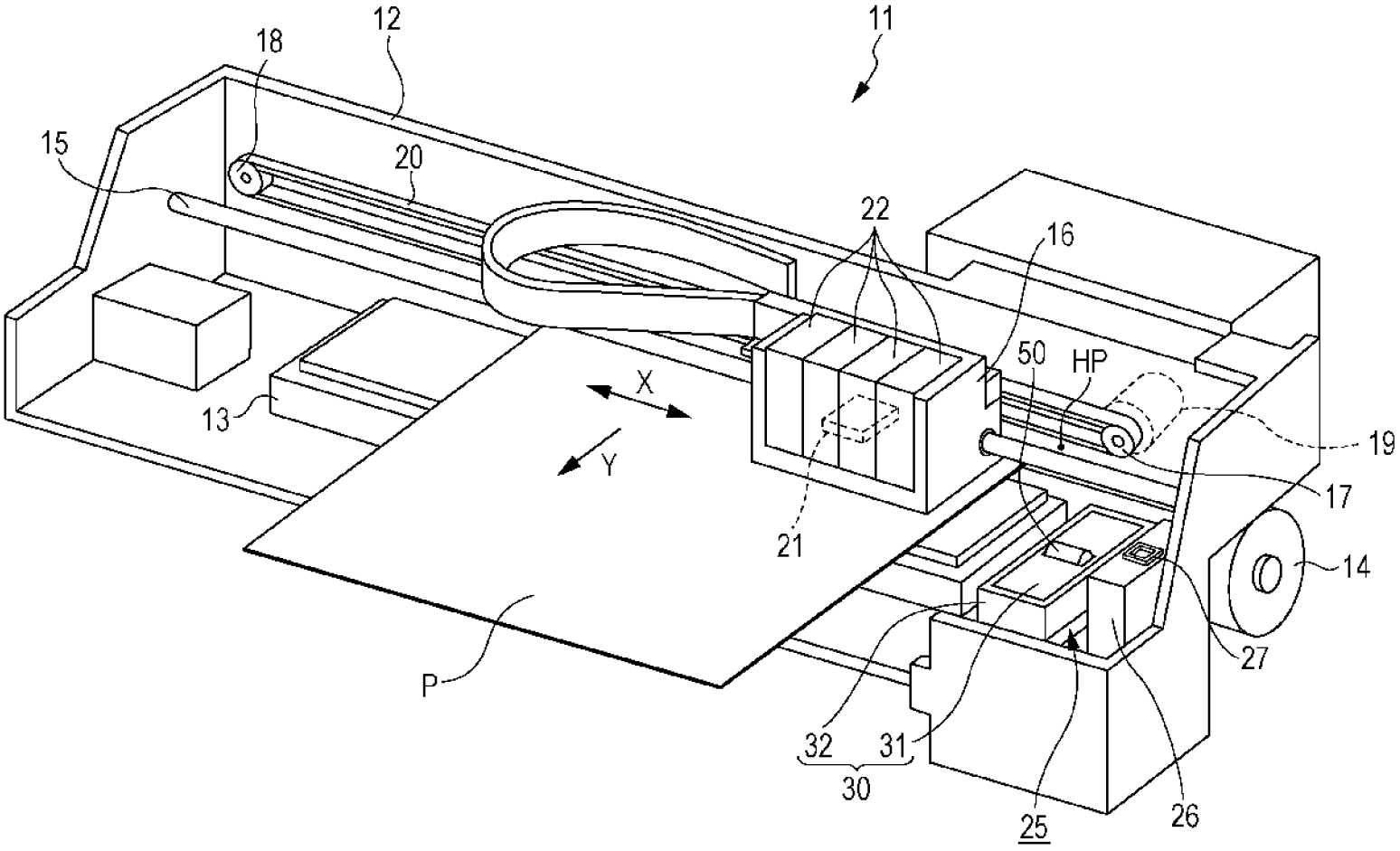
FIG. 1 is a perspective view of an ink jet printer according to an embodiment.

As shown in FIG. 1, in a printer 11, a support base 13 having a substantially rectangular plate-like shape is disposed in a lower portion in the direction of gravity within a body casing 12 having a substantially rectangular box-like shape. A longitudinal direction of the support base 13 corresponds to a main scanning direction X. Paper sheets P are fed onto the support base 13 in a sub-scanning direction Y which intersects the main scanning direction X by operation of a paper feeding motor 14 disposed below a rear surface of the body casing 12. In addition, a stick-like guiding shaft 15 which extends parallel to the longitudinal direction of the support base 13 is disposed above the support base 13 within the body casing 12. The guiding shaft 15 supports a carriage 16 so that the carriage 16 is able to reciprocate in an axial direction of the guiding shaft 15.

On an inner surface of a rear wall of the body casing 12, a driving motor 17 and a driven pulley 18 are rotatably supported at respective positions which correspond to the respective ends of the guiding shaft 15. The driving motor 17 is connected to an output shaft of the carriage motor 19 which is a driving source for causing the carriage 16 to reciprocate. In addition, an endless timing belt 20 is entrained between the driving motor 17 and the driven pulley 18. A portion of the endless timing belt 20 is connected to the carriage 16. Consequently, the carriage 16 may be moved in the main scanning direction X via the endless timing belt 20 by the carriage motor 19 while being guided by the guiding shaft 15.

A liquid ejecting head 21 is disposed on a lower surface of the carriage 16 opposing the support base 13. On the other hand, a plurality of ink cartridges 22 for storing ink, i.e., liquid to be supplied to the liquid ejecting head 21 are removably provided in the carriage 16. Ink is supplied from the ink cartridges 22. Then, the liquid ejecting head 21 ejects the ink through the nozzles 63 (see FIG. 2) formed in the nozzle face 21*a* which is a lower surface of the liquid ejecting head 21, to the paper sheets P fed onto the support base 13.

In addition, within the body casing 12, a maintenance unit 25 for performing maintenance of the liquid ejecting head 21 is disposed in a home position HP. The home position HP is defined outside of the region in which the paper sheets P are transported.

The maintenance unit 25 includes a head-suction device 26 and a cleaning device 30. The head-suction device 26 has a cap 27 that abuts the liquid ejecting head 21 so as to surround the nozzles 63, and a pump (not shown) that operates to suction and discharge the ink on the nozzles 63 of the liquid ejecting head 21 through the cap 27. The cleaning device 30 has a cassette holder 32 in which a cleaning member cassette 31 is removably placed, and a driving mechanism (not shown) that relatively moves the cassette holder 32 with respect to the liquid ejecting head 21.

Figure 2:
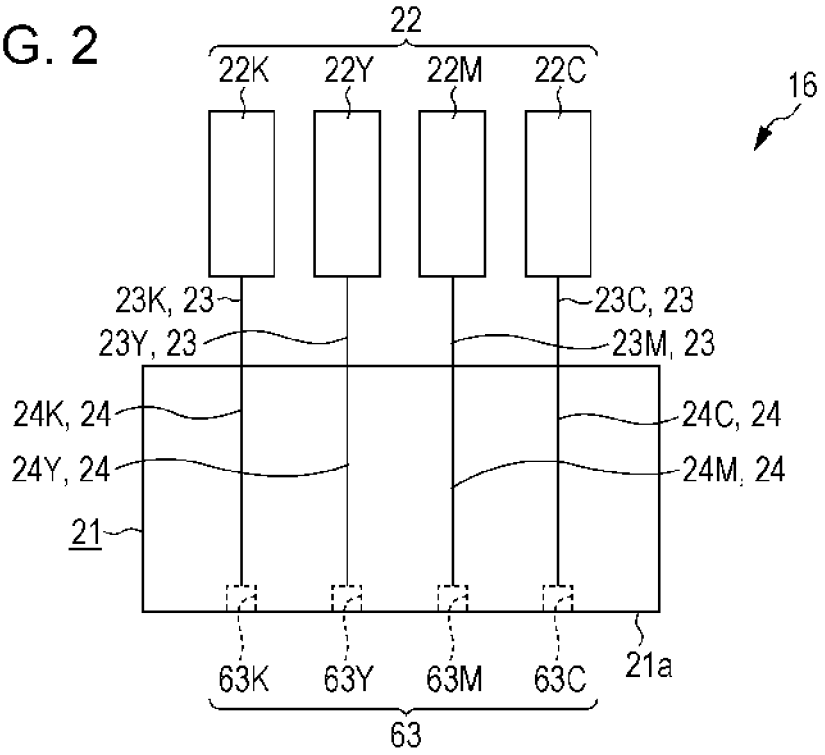
FIG. 2 is a schematic block diagram of a liquid ejecting head of the ink jet printer according to the embodiment.
Figure 3:
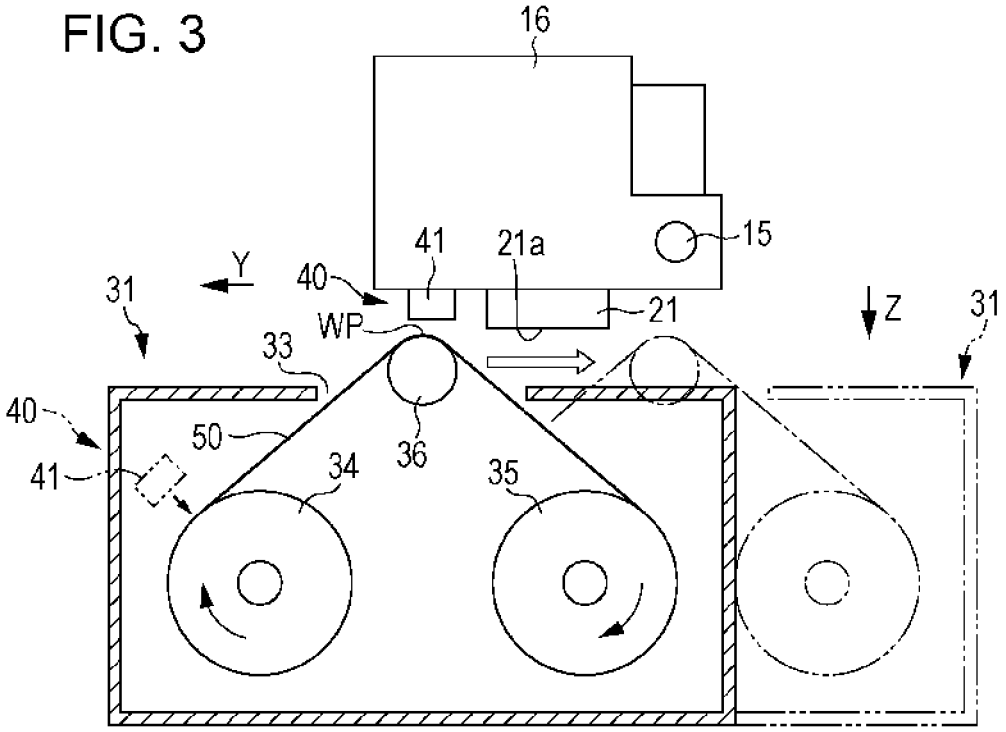
FIG. 3 is a diagram of a cleaning device of the ink jet printer according to the embodiment.

As shown in FIG. 2, in this embodiment, the carriage 16 is provided with ink cartridges 22 for four colors (22C, 22M, 22Y, 22K (22C to 22K). The liquid ejecting head 21 has as many nozzles 63 (63C to 63K) as ink cartridges 22. In addition, the carriage 16 includes, as shown in FIG. 3, a cleaning liquid supplying mechanism 40. The cleaning liquid supplying mechanism 40 has a cleaning liquid storing tank (not shown) that stores a cleaning liquid for softening thickened and solidified ink, and an ejecting section 41 for ejecting the cleaning liquid. The cleaning liquid is created using, for example, a mixed solution of an organic amine, a surface-active agent, and pure water.

The ink in the ink cartridges 22 is supplied from the ink cartridges 22 through first flow channels 23 (23C to 23K) to the liquid ejecting head 21 by operation of piezoelectric elements (not shown) provided in the liquid ejecting head 21. Then, the supplied ink flows through second flow channels 24 (24C to 24K) disposed in the liquid ejecting head 21 and is ejected from the nozzles 63 of the liquid ejecting head 21 onto paper sheets P fed onto the support base 13, whereby printing is performed.

A configuration of the cleaning device 30 will now be described with reference to FIG. 3.

As shown in FIG. 3, the cleaning member cassette 31 has a pair of a first roller 34 and a second roller 35, each having an axis extending substantially parallel to the main scanning direction X. The main scanning direction X intersects the sub-scanning direction Y, i.e., a movement direction of the cassette holder 32 in which the cleaning member cassette 31 is placed. An elongated strip-shaped cleaning member 50 has a width which can handle the total area of the nozzle face 21*a* in which the nozzles 63 of the liquid ejecting head 21 are formed, and is entrained between the first roller 34 and the second roller 35. One of the first roller 34 and the second roller 35 (the first roller 34 herein) serves as a feeding roller for feeding a length of unused wound cleaning member 50. The other of the first roller 34 and the second roller 35 (the second roller 35 herein) serves as a winding roller for winding in the cleaning member 50 which has been unwound and fed from the feeding roller and then has been used for cleaning.

In addition, in the cleaning member cassette 31, an elastic roller 36 is disposed on the feeding path of the cleaning member 50 from the first roller 34 to the second roller 35. The elastic roller 36 extends parallel to the first roller 34 and the second roller 35, and both ends of the elastic roller 36 in the axial direction are rotatably supported by bearings or the like disposed in the cleaning member cassette 31. The elastic roller 36 has an outer periphery constructed by, for example, a sponge. Then, an intermediate portion between the portion of the cleaning member 50 that is entrained on the first roller 34 and the portion of the cleaning member 50 that is entrained the second roller 35 is mounted on the top of the elastic roller 36.

Figure 5:
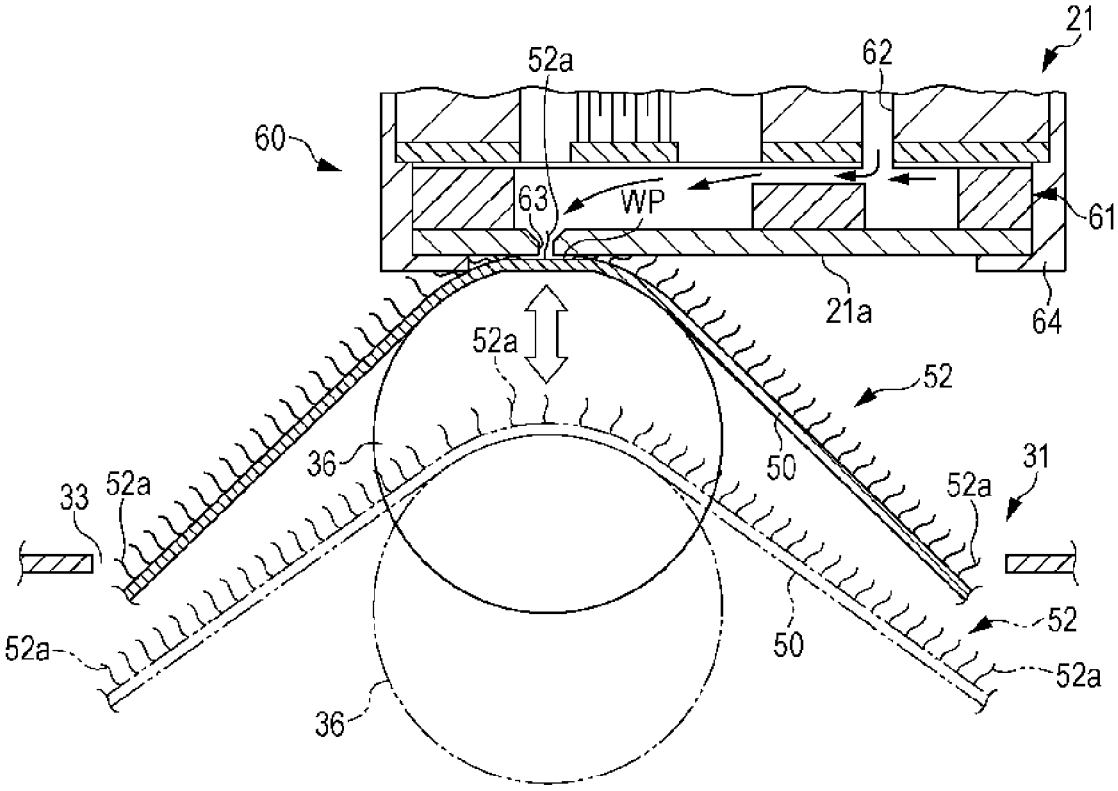
FIG. 5 is an enlarged structural diagram of important portions of the liquid ejecting head of the ink jet printer according to the embodiment.

The cleaning device 30 has a function in which the elastic roller 36 may move in the cleaning member cassette 31 in the direction of gravity Z and the opposite direction (see FIG. 5). This function is achieved, for example, due to the fact that the bearings for the elastic roller 36 are configured to be vertically movable by engagement with a cam mechanism. FIG. 3 shows that the elastic roller 36 in the cleaning member cassette 31 has moved in the direction opposite the direction of gravity Z. The elastic roller 36 protrudes above an upper surface of the cleaning member cassette 31 through a rectangular cassette opening 33 formed in the upper surface of the cleaning member cassette 31 when the elastic roller 36 has moved in the direction opposite the direction of gravity Z. Therefore, a portion of the cleaning member 50 that is mounted on the elastic roller 36 protrudes above the upper surface of the cleaning member cassette 31. At the same time, the uppermost portion of the cleaning member 50 that is mounted on the elastic roller 36 is located below a lower surface of the liquid ejecting head 21, and the full width of the cleaning member 50 orthogonal to a feeding direction is exposed out of the cleaning member cassette 31 from the cassette opening 33 of the cleaning member cassette 31.

In addition, the shaft for the elastic roller 36 vertically movably held on the bearings may be urged in the direction opposite to the direction of gravity Z using an elastic member such as a torsion bar spring or a helical compression spring, whereby, a pressing load applied when the cleaning member 50 is brought into contact with the region including the nozzle face 21*a* during cleaning may be adjusted.

Figure 4:
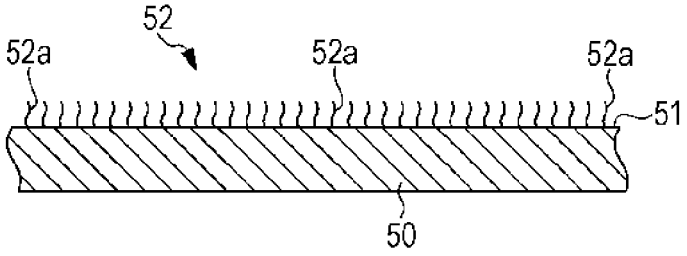
FIG. 4 is a structural diagram of the cleaning member of the ink jet printer according to the embodiment.

As shown in FIG. 4, the elongated strip-shaped cleaning member 50 has a pile section 52 in which a plurality of pile elements 52*a* are raised and which is formed on a contact surface 51 opposite a surface in contact with the elastic roller 36. The contact surface 51 is a surface which is brought into contact with the nozzle face 21*a* of the liquid ejecting head 21 when the cleaning member 50 entrained on the first roller 34 and the second roller 35 cleans the liquid ejecting head 21. The cleaning member 50 is formed of cloth made of, for example, natural fibers, synthetic fibers, or the like. The plurality of raised pile elements 52*a* on the pile section 52 are formed of, for example, fibers. The raised pile elements 52*a* on the pile section 52 have a thickness smaller than an orifice size of the nozzles 63 and, if the cross-section of the raised pile elements 52*a* is circular, preferably have a diameter less than or equal to 20 μm. In addition, the raised pile elements 52*a* on the pile section 52 have a length such that the pile elements 52*a* can enter nozzles 63.

As shown in FIG. 5, a head body 60 of the liquid ejecting head 21 has an ink supplying section 61 which includes an ink introduction passage 62. The ink introduction passage 62 forms a portion of a second flow channel 24 which introduces ink from a first flow channel 23. In the ink supplying section 61, the nozzles 63 for jetting the ink are formed in the nozzle face 21*a*.

During cleaning of the liquid ejecting head 21, the cassette holder 32 and the cleaning member cassette 31 of the cleaning device 30 move in the main scanning direction X and the sub-scanning direction Y so that the cleaning member 50 protruding from the cassette opening 33 and the nozzles 63 are directly face each other. After that, the elastic roller 36 in the cleaning member cassette 31 of the cleaning device 30 repeatedly moves several times in the direction of gravity Z and the opposite direction as shown by an outlined arrow in this figure. That is, the elastic roller 36 moves between a lower position in the direction of gravity Z shown in a chain double-dashed line in this figure and an upper position in the opposite side shown in a solid line, while the intermediate portion between the portion of the cleaning member 50 that is entrained on the first roller 34 and the portion of the cleaning member 50 that is entrained on the second roller 35 is mounted on the elastic roller 36.

In the portion of the cleaning member 50 that is mounted on the elastic roller 36 and protrudes from the cassette opening 33, the contact surface 51 on which the pile section 52 is formed is pressed against the nozzle face 21*a* of the liquid ejecting head 21 when the elastic roller 36 has moved to the upper position. The elastic roller 36 deforms due to the fact that the cleaning member 50 is pressed against the nozzle face 21*a* of the liquid ejecting head 21. As a result, in the pressed uppermost position of the cleaning member 50, a substantially rectangular abutment region WP is created. The abutment region WP has a longitudinal direction which corresponds to the axial direction of the elastic roller 36. Consequently, the abutment region WP of the cleaning member 50 is contact with the region including the nozzle face 21*a* during cleaning.

On the other hand, when the elastic roller 36 has moved to the lower position, the portion of the cleaning member 50 that is mounted on the elastic roller 36 and protrudes from the cassette opening 33 separates from the nozzle face 21*a* of the liquid ejecting head 21, whereby the cleaning member 50 and the nozzle face 21*a* are not in contact with each other.

That is, when the cleaning device 30 cleans the liquid ejecting head 21, the portion of the cleaning member 50 that protrudes from the cassette opening 33 repeatedly comes into contact with and separates from the nozzle face 21*a* of the liquid ejecting head 21 several times.

After that, while the elastic roller 36 is in the upper position, as shown in FIG. 3, the cleaning device 30 moves the cassette holder 32 from a position shown by a solid line in this figure to a position shown by a chain double-dashed line in a direction opposite the sub-scanning direction Y. As a result, the portion of the cleaning member 50 that protrudes from the cassette opening 33 relatively moves with respect to the liquid ejecting head 21 as shown by the outlined arrow in this figure. The cleaning member 50 is pressed against and moves along the nozzle face 21*a*, whereby the abutment region WP moves along and wipes the nozzle face 21*a*.

Moreover, when the cleaning member 50 wipes the nozzle face 21*a*, the carriage 16 has moved along the guiding shaft 15 to the home position HP. In addition, as shown in FIG. 3, when the cleaning member cassette 31 is positioned in an initial position of the wiping operation and the carriage 16 has moved to the home position HP, the liquid ejecting head 21 is positioned apart from the elastic roller 36 in a direction opposite the sub-scanning direction Y.

The cleaning operation of the cleaning device 30 according to this embodiment will now be described. In the following description, the cleaning operation in the case that the solid materials are inside the nozzles 63 will be described.

During cleaning of the liquid ejecting head 21, the cleaning device 30 moves the cassette holder 32 so that the portion of the cleaning member 50 that is mounted on the elastic roller 36 and protrudes from the cassette opening 33 and the ejecting section 41 of the cleaning liquid supplying mechanism 40 directly face each other. Then, the cleaning liquid supplying mechanism 40 jets the cleaning liquid stored in the cleaning liquid storing tank through the ejecting section 41. This operation causes the cleaning liquid that has jetted from the ejecting section 41 to be supplied to the portion of the cleaning member 50 that protrudes from the cassette opening 33.

The cleaning device 30, as shown in FIG. 5, moves the elastic roller 36 between the lower position and the upper position, whereby the portion of the cleaning member 50 that is mounted on the elastic roller 36 repeatedly comes into contact with and separates from the nozzle face 21*a* of the liquid ejecting head 21 several times.

When the elastic roller 36 is in proximity to the upper position, the abutment region WP of the cleaning member 50 is pressed against the nozzle face 21*a*. Therefore, in the portion of the pile section 52 of the cleaning member 50 that protrudes from the cassette opening 33, the pile elements 52*a* has a diameter smaller than the orifice size of the nozzles 63, whereby the tips of the pile elements 52*a* enter the nozzles 63. The pile elements 52*a* whose tips have entered the nozzles 63 impinge against the solid materials in the nozzles 63 in conjunction with the movement of the elastic roller 36 from the lower position toward the upper position. Therefore, the solid materials in the nozzles 63 are impinged by the pile elements 52*a* on the pile section 52 whose tips enter the nozzles 63 to be broken up and divided into small pieces. Moreover, the solid materials in the nozzles 63 are in contact with the portion of the cleaning member 50 that protrudes from the cassette opening 33 so that the solid materials in the nozzles 63 are supplied with the cleaning liquid and softened. Therefore, the solid materials in the nozzles 63 are easily divided into small pieces due to the impingement by the raised pile elements 52*a*.

While the abutment region WP of the cleaning member 50 that protrudes from the cassette opening 33 is in contact with the nozzle face 21*a* of the liquid ejecting head 21, the cleaning device 30 moves the cleaning member cassette 31 in the direction opposite the sub-scanning direction Y as shown in FIG. 3 in order to wipe the nozzle face 21*a*. This wiping causes the cleaning member 50 formed by cloth to absorb the ink remaining on the nozzles 63 and the nozzle face 21*a*. In addition, some or all of the solid materials in the nozzles 63 divided into small pieces are discharged from the nozzles 63 in conjunction with the movement of the cleaning member 50.

When the wiping operation using the cleaning member 50 is completed, the carriage 16 moves along the guiding shaft 15 to the position at which the nozzles 63 of the liquid ejecting head 21 abuts the cap 27 of the head-suction device 26. Then, while the nozzle face 21*a* of the liquid ejecting head 21 abuts the cap 27, the head-suction device 26 causes negative pressure to act on the nozzles 63 to suck the small pieces of the solid materials remaining on the nozzles 63 together with the ink.

According to the above described embodiment, following effects may be obtained.

(1) When the cleaning member 50 is brought into contact with the region including the nozzle face 21*a* of the liquid ejecting head 21, the tips of the raised pile elements 52*a* on the pile section 52 enter the nozzles 63, and impinge against the solid materials remaining and solidified on the nozzles 63. Therefore, the solid materials remaining on the nozzles 63 are physically broken due to the impingement by the pile elements 52*a* on the pile section 52. After that, for example, if negative pressure acts on the nozzles 63, the solid materials are easily discharged out of the nozzles 63. Consequently, an effect of removing the solid materials remaining on the nozzles 63 of the liquid ejecting head 21 may be enhanced.

(2) The raised pile elements 52*a* on the pile section 52 has a thickness smaller than orifice size of the nozzles 63 and a length such that the raised pile elements 52*a* are capable of entering the nozzles 63. Therefore, the raised pile elements 52*a* on the pile section 52 formed on the cleaning member 50 easily enter the nozzles 63 when the cleaning member 50 is brought into contact with the region including the nozzle face 21*a* of the liquid ejecting head 21 during cleaning of the liquid ejecting head 21. Therefore, during cleaning of the liquid ejecting head 21, the cleaning device 30 causes the raised pile elements 52*a* to easily impinge against the solid materials remaining on the nozzles 63. Therefore, the cleaning device 30 for the liquid ejecting head 21 may effectively break the solid materials remaining on the nozzles 63 using the raised pile elements 52*a*.

(3) The cleaning member 50 is a cloth, and the raised pile elements 52*a* are formed of fibers each having a diameter smaller than 20 μm. Therefore, the raised pile elements 52*a* on the pile section 52 easily enter the nozzles 63 during cleaning of the liquid ejecting head 21. In addition, the cleaning member 50 is brought into contact with the nozzle face 21*a* of the liquid ejecting head 21 so as to absorb the ink remaining on the nozzles 63 and the nozzle face 21*a* of the liquid ejecting head 21. Therefore, an effect of cleaning the liquid ejecting head 21 may be enhanced.

(4) The ink jet printer 11 includes the liquid ejecting head 21 that ejects liquid from the nozzles 63 and the cleaning device 30 for the liquid ejecting head 21 having the above-described configuration. Therefore, the ink jet printer 11 is obtained in which an effect of removing the solid materials remaining on the nozzles 63 of the liquid ejecting head 21 may be enhanced.

(5) The ink jet printer 11 includes the cleaning liquid supplying mechanism 40 that supplies a cleaning liquid to the cleaning member 50. Therefore, the ink jet printer 11 may provide the cleaning liquid via the cleaning member 50 to the solid materials remaining on the nozzles 63 of the liquid ejecting head 21 to soften the solidified ink or the like. Therefore, according to the ink jet printer 11, the raised pile elements 52*a* on the pile section 52 may easily break the solid materials, i.e. the solidified ink, during cleaning of the liquid ejecting head 21. Therefore, in the ink jet printer 11, efficiency in removing the solid materials remaining on the nozzles 63 of the liquid ejecting head 21 may be increased.

Moreover, the above embodiment may be changed into other embodiments in the following.

In the above embodiment, as long as the tips of the raised pile elements 52*a* on the pile section 52 is capable of entering the nozzles 63, the cleaning member 50 need not be in contact with the nozzle face 21*a* of the liquid ejecting head 21. For example, as shown in FIG. 5, if a covering member 64 is disposed so as to surround the nozzles 63 of the nozzle face 21*a*, the cleaning member 50 will be in contact only with the covering member 64, i.e. the region including the nozzle face 21*a* in this case, depending on the pressing load of the cleaning member 50 by the elastic roller 36 in the direction toward the nozzle face 21*a*. Even in this case, if the tips of the raised pile elements 52*a* on the pile section 52 are configured to enter the nozzles 63, similar effect may be obtained as is the case that the cleaning member 50 is in contact with the nozzle face 21*a* of the liquid ejecting head 21. In addition, even if the cleaning member 50 is not contact with the nozzle face 21*a*, the raised pile elements 52*a* on the pile section 52 is brought into contact with the nozzle face 21*a*, whereby the ink remaining on the nozzle face 21*a* will be absorbed through the pile section 52 by the cleaning member 50.

In the above embodiment, when the cleaning device 30 cleans the liquid ejecting head 21, the portion of the cleaning member 50 that protrudes from the cassette opening 33 need not be in contact with and separate from the nozzle face 21*a* of the liquid ejecting head 21.

In the above embodiment, the cleaning liquid supplying mechanism 40 may be disposed on the side of the cleaning member cassette 31 as shown by the chain double-dashed line in FIG. 3 and, for example, the cleaning liquid may be ejected to a portion mounted between the first roller 34 serving as a feeding roller for the cleaning member 50 and the elastic roller 36.

In the above embodiment, the cleaning liquid supplying mechanism 40 need not be included. In this case, the cleaning member 50 may be impregnated with the cleaning liquid in advance.

In the above embodiment, in the cleaning device 30, in the state that the abutment region WP of the cleaning member 50 that protrudes from the cassette opening 33 is in contact with the nozzle face 21*a* of the liquid ejecting head 21, the cleaning member cassette 31 may be moved so as to wipe the nozzle face 21*a* while the cleaning member 50 is fed from the first roller 34 and wound in around the second roller 35. Then, the pile section 52 of the cleaning member 50 effectively breaks the solid materials, i.e. the ink remaining and solidified on the nozzles 63.

In the above embodiment, the cleaning member cassette 31 may not necessarily have a configuration in which the cleaning member 50 is mounted on the elastic roller 36. These variations will be described with reference to FIGS. 6A and 6B.

Figure 6A:
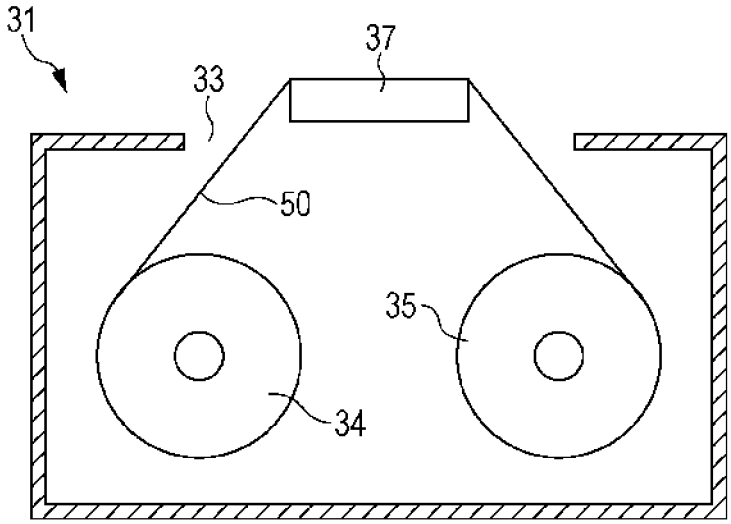
FIG. 6A is a diagram showing an example of a cleaning member cassette according to a variation and FIG. 6B is a diagram showing an example of a cleaning member cassette according to another variation.

As shown in FIG. 6A, the cleaning member cassette 31 of the cleaning device 30 has a configuration in which the cleaning member 50 entrained between the first roller 34 and the second roller 35 is mounted on a small plate 37 which is vertically movable. A portion of the cleaning member 50 that is mounted on the small plate 37 and is positioned above the small plate 37 protrudes from the cassette opening 33. During cleaning of the liquid ejecting head 21, the portion of the cleaning member 50 that is positioned above the small plate 37 is pressed against the nozzle face 21*a* of the liquid ejecting head 21.

According to this configuration, the cleaning device 30 may press the cleaning member 50 against the nozzle face 21*a* of the liquid ejecting head 21 over a large area during cleaning of the liquid ejecting head 21. Therefore, the cleaning device 30 may impinge the raised pile elements on the cleaning member 50 against the solid materials in the nozzles 63 over a large area. Therefore, efficiency in breaking of the solid materials by the raised pile elements may be increased.

Figure 6B:
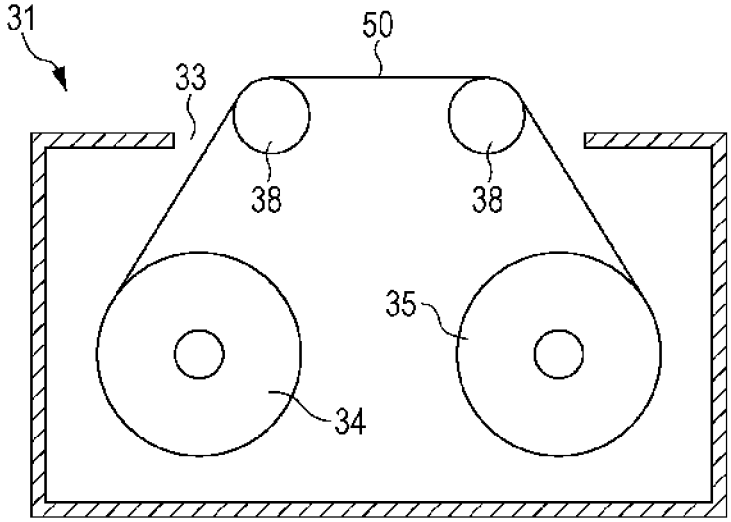

As shown in FIG. 6B, in the cleaning member cassette 31 of the cleaning device 30, a portion of the cleaning member 50 that is entrained between the first roller 34 and the second roller 35 is lifted up by a pair of vertically movable member-supporting pulleys 38. In addition, the portion of the cleaning member 50 that is lifted up by the pair of member-supporting pulleys 38 protrudes from the cassette opening 33. During cleaning of the liquid ejecting head 21, the portion of the cleaning member 50 between the pair of the member-supporting pulleys 38 is lifted up by the member-supporting pulleys 38 so as to be pressed against the nozzle face 21*a* of the liquid ejecting head 21.

According to this configuration, the cleaning device 30 may gently press the cleaning member 50 against the nozzle face 21*a* of the liquid ejecting head 21 during cleaning of the liquid ejecting head 21. Therefore, a portion of the raised pile elements in a proximity to the nozzles 63 easily enter the nozzles.

In the above embodiment, the raised pile elements on the cleaning member 50 are not necessarily fibers. For example, the raised pile elements on the cleaning member 50 according to this variation are formed of polymeric material such as plastic material.

In the above embodiment, the ink jet printer 11 performs the following operations after the cleaning member 50 is pressed against and wipes the nozzle face 21*a* of the liquid ejecting head 21. The ink jet printer 11 have ink discharged from the nozzles 63 by operation of piezoelectric elements of the liquid ejecting head 21 or a separately disposed compression mechanism that is capable of compressing the ink in the ink cartridges 22 or the first flow channels 23. Because of this, an effect of removing the solid materials remaining on the nozzles 63 may be enhanced.

In the above embodiment, the cleaning device 30 may move the cleaning member 50 in a direction that intersects the nozzle arrays of the liquid ejecting head 21 in order to wipe the nozzle face 21*a* of the liquid ejecting head 21 during the liquid ejecting head 21.

In the above embodiment, the cleaning device 30 may have a cleaning member 50 with a pile section 52 and a second cleaning member without a pile section. The cleaning device 30 may break the solid materials in the nozzles 63 using the cleaning member 50 with the pile section 52 before it wipes the nozzle face 21*a* of the liquid ejecting head 21 using the second cleaning member.

In the above embodiment, the cleaning liquid supplying mechanism 40 may be disposed in a position opposing the liquid ejecting head 21, and the cleaning liquid may be provided to the nozzle face 21*a* before the cleaning member 50 wipes the nozzle face 21*a*. Also according to this configuration, the ink solidified on the nozzles 63 of the liquid ejecting head 21 may be softened.

Figure 7A:
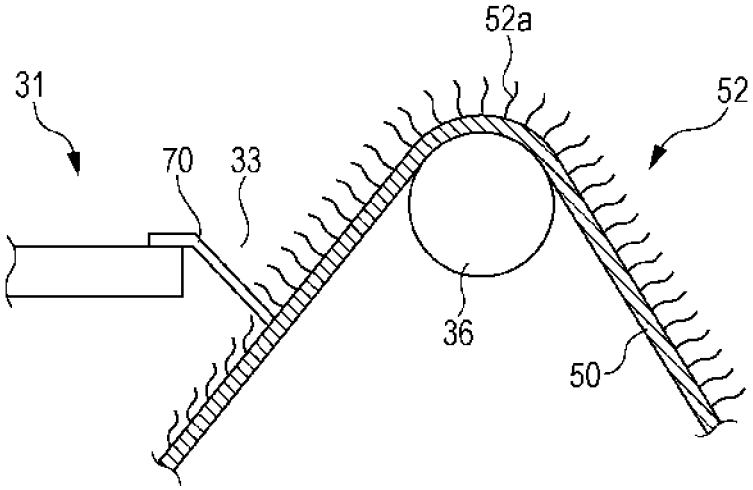
FIG. 7A is a diagram showing an example of a cleaning member cassette with a pile raising member according to a variation and FIG. 7B is a diagram showing an example of a cleaning member cassette with a pile raising member according to another variation.
Figure 7B:
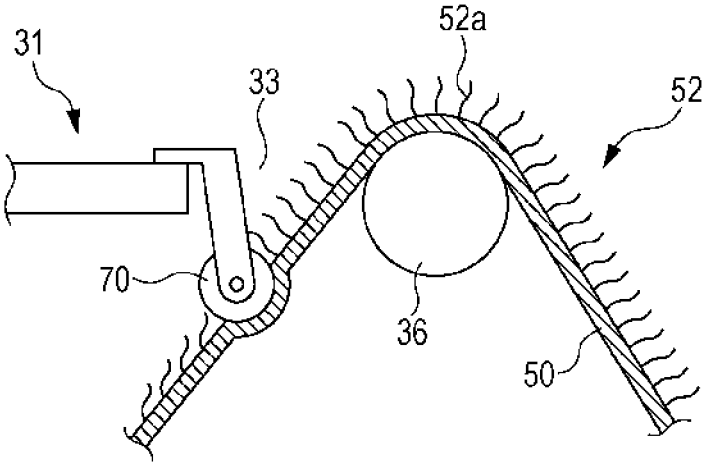

In the above embodiment, as shown in FIGS. 7A and 7B, in the cleaning member cassette 31, a pile raising member 70 may be disposed so that is brought into contact with the portion of the cleaning member 50 mounted between the feeding roller and the elastic roller 36. The pile raising member 70 may raise the pile elements 52*a* on the pile section 52 of the cleaning member 50 before the cleaning member 50 wipes the nozzle face 21*a*. According to this configuration, the pile elements 52*a* on the pile section 52 which have lain down when they have been wound in may be raised in order to impinge against the solid materials remaining on the nozzles 63. The pile raising member 70 may be a member similar to a thin plate in FIG. 7A or a rotating roller having adhesive surface similar to FIG. 7B.

In the above embodiment, the liquid ejecting apparatus may be a liquid ejecting apparatus for ejecting or discharging a liquid other than an ink. Moreover, a liquid to be discharged in a very small amount of liquid droplets from the liquid ejecting apparatus may also include a liquid that leaves a granular shape, a teardrop shape, a threadlike shape trail. In addition, the term "liquid" herein should be such a material that is capable of being ejected from the liquid ejecting apparatus. For example, the "liquid" may be any material in the liquid phase and may include liquid-state materials of high viscosity or low viscosity, sols, gel water, various inorganic solvents and organic solvents, solutions, liquid resins and liquid metals (metal melts). In addition, the "liquid" may include not only a liquid as one state of materials, but solvents in which particles of a functional material including solid material such as pigment and metallic particles are dissolved, dispersed, or mixed. A typical example of the liquids may be an ink, a liquid crystal, or the like described in the above embodiments. The term "ink" herein may include a variety of compositions in the form of a liquid, such as a common water-soluble ink and an oil-soluble ink as well as a gel ink, a hot-melt ink, and the like. One specific example of the liquid ejecting apparatus includes, for example, a liquid ejecting apparatus for ejecting a liquid containing an electrode material, a colorant, or the like in a dispersed or dissolved form, which is used for manufacturing a liquid crystal display device, an EL (electroluminescent) display device, a surface emission display device, a color filter. Alternatively, it may be a liquid ejecting apparatus for ejecting bio-organic substance used for bio-chip production, a liquid ejecting apparatus for ejecting a liquid as a test sample, used as a precision pipette, a printing apparatus, a micro-dispenser or the like. It may also be a liquid ejecting apparatus for ejecting a lubricant at pinpoints onto a precision machine such as a timepiece, a camera, or the like, a liquid ejecting apparatus for ejecting a translucent resin liquid such as an ultraviolet-curable resin onto a substrate, for forming a hemispherical micro-lens (an optical lens) or the like used in an optical communication element or the like. Also, it may be a liquid ejecting apparatus for ejecting an etching solution, such as an acid or an alkali in order to etch a substrate or the like.

The entire disclosure of Japanese Patent Application No. 2013-230941, filed Nov. 7, 2013 is expressly incorporated by reference herein.

What is claimed is:

1. A cleaning device for a liquid ejecting head, the cleaning device comprising:

a cleaning member that is brought into contact with a region including a nozzle face of the liquid ejecting head that ejects a liquid from nozzles formed in the nozzle face such that the cleaning member is capable of cleaning the liquid ejecting head, the cleaning member including a pile section in which a plurality of pile elements are raised is formed in a contact portion side of the cleaning member that is brought into contact with the region of the liquid ejecting head when the cleaning member cleans the liquid ejecting head; and a cleaning liquid supplying mechanism that supplies a cleaning liquid to the pile section from the contact portion side.

2. The cleaning device for a liquid ejecting head according to claim 1, wherein the raised pile elements have a thickness smaller than the orifice size of the nozzles, and have a length such that the raised pile elements are capable of entering the nozzles.

3. The cleaning device for a liquid ejecting head according to claim 1, wherein the cleaning member is a cloth, and the raised pile elements are formed of fibers each having a diameter smaller than 20 μm.

4. The cleaning device for a liquid ejecting head according to claim 1, further comprising a second cleaning member that does not have a pile section in a portion in contact with the region, the second cleaning member being disposed to be capable of wiping the region after the cleaning member has been in contact with the region of the liquid ejecting head.

5. The cleaning device for a liquid ejecting head according to claim 1, further comprising:

a pressing member that contacts the cleaning member to the region by contacting from an opposite side of the contact side; and a pile raising member that raises the pile elements on the pile section by contacting from the contact portion side with the pile section before the pile section is brought into contact with the pressing member.

6. A liquid ejecting apparatus, comprising:

a liquid ejecting head that ejects a liquid from nozzles formed in a nozzle face;

a cleaning member that is brought into contact with a region including the nozzle face of the liquid ejecting head so as to be capable of cleaning the liquid ejecting head, the cleaning member including a pile section in which a plurality of pile elements are raised is formed in a contact portion side of the cleaning member that is brought into contact with the region including the nozzle face when the cleaning member cleans the liquid ejecting head; and a cleaning liquid supplying mechanism that supplies a cleaning liquid to the pile section from the contact portion side.

7. The liquid ejecting apparatus according to claim 6, wherein the raised pile elements have a thickness smaller than the orifice size of the nozzles, and have a length such that the raised pile elements are capable of entering the nozzles.

8. The liquid ejecting apparatus according to claim 6, wherein the cleaning member is a cloth, and the raised pile elements are formed of fibers each having a diameter smaller than 20 μm.

9. The liquid ejecting apparatus according to claim 6, further comprising:

a second cleaning member that does not have a pile section in a portion in contact with the region, the second cleaning member being disposed to be capable of wiping the region of the liquid ejecting head, wherein, after the cleaning member has been in contact with the region of the liquid ejecting head, the second cleaning member is brought into contact with the region.

10. The liquid ejecting apparatus according to claim 6, further comprising a cleaning liquid supplying mechanism that supplies a cleaning liquid to at least one of the nozzle face of the liquid ejecting head and the cleaning member.

11. The liquid ejecting apparatus according to claim 1, wherein the cleaning liquid contains an organic amine and a surface-active agent.

12. The liquid ejecting apparatus according to claim 5, wherein the pile raising member is shaped like a thin plate.

13. The liquid ejecting apparatus according to claim 5, wherein the pile raising member is a roller having an adhesive surface.

14. The liquid ejecting apparatus according to claim 6, wherein the pile section repeatedly comes contact with and separates from the region during the cleaning operation of the liquid ejecting head.

15. The liquid ejecting apparatus according to claim 6, wherein the liquid is discharged from nozzles by compressing the liquid in the liquid ejecting head or a supply path for supplying the liquid to the liquid ejecting head.

16. A liquid ejecting apparatus, comprising:

a liquid ejecting head that ejects a liquid from nozzles formed in a nozzle face; and a cleaning device that is brought into contact with a region including the nozzle face of the liquid ejecting head so as to be capable of cleaning the liquid ejecting head, the cleaning device including:

a cleaning portion that has a pile section in which a plurality of pile elements are raised is formed in a contact portion side of the cleaning device that is brought into contact with the region including the nozzle face when the cleaning device cleans the liquid ejecting head; and a second cleaning portion that does not have a pile section in a portion in contact with the region, the second cleaning portion being disposed to be capable of wiping the region after the cleaning portion has been in contact with the region of the liquid ejecting head.

17. The liquid ejecting apparatus according to claim 16, further comprising:

a cleaning liquid supplying mechanism that supplies a cleaning liquid to the pile section.

18. A liquid ejecting apparatus, comprising:

a liquid ejecting head that is carried on a carriage and ejects a liquid from nozzles formed in a nozzle face; and a cleaning member that is brought into contact with a region including the nozzle face of the liquid ejecting head so as to be capable of cleaning the liquid ejecting head, wherein a pile section in which a plurality of pile elements are raised is formed in a portion of the cleaning member that is brought into contact with the region including the nozzle face when the cleaning member cleans the liquid ejecting head, and wherein a portion of the cleaning member is configured to be positioned opposite a cleaning liquid supply mechanism that is carried on the carriage.

* * * * *